United States Patent [19]

Akkerman

[11] 4,297,087

[45] Oct. 27, 1981

[54] APPARATUS FOR PUMPING FLUID FROM A WELL THROUGH A TUBING STRING

[75] Inventor: Neil H. Akkerman, Kingwood, Tex.

[73] Assignee: Baker International Corporation, Orange, Calif.

[21] Appl. No.: 69,209

[22] Filed: Aug. 23, 1979

[51] Int. Cl.[3] ..... F04B 9/08

[52] U.S. Cl. ..... 417/378

[58] Field of Search ..... 417/378, 377, 349, 374

[56] References Cited

U.S. PATENT DOCUMENTS

| | | | |
|---|---|---|---|
| 2,058,455 | 10/1936 | Huff | 417/378 |
| 2,095,475 | 10/1939 | Kittler | 417/378 |
| 2,123,139 | 7/1938 | Huff | 417/377 |
| 2,126,880 | 8/1938 | Gardner | 417/378 |
| 2,508,609 | 5/1950 | Johnson | 417/378 |
| 2,544,094 | 3/1951 | Knowles | 417/377 |
| 4,172,692 | 10/1979 | Everett | 417/374 |

*Primary Examiner*—Billy S. Taylor

*Attorney, Agent, or Firm*—William C. Norvell, Jr.

[57] ABSTRACT

An apparatus is provided for pumping fluid from a subterranean well through a tubing string. A pressure actuated subsurface pump and a surface unit are in fluid communication with opposite ends of the tubing string. The surface unit cyclically applies pressure to the fluid in the tubing string to actuate the subsurface pump and cause a radial expansion of the tubing such that potential energy is stored in the tubing string. Each time the surface unit removes the applied pressure, the stored potential energy is released to the surface unit which converts the potential energy into kinetic energy for use in the next pumping cycle.

27 Claims, 2 Drawing Figures

APPARATUS FOR PUMPING FLUID FROM A WELL THROUGH A TUBING STRING

CROSS-REFERENCE TO RELATED APPLICATIONS

This application is related in subject matter to co-pending application Ser. No. 073,335, filed Sept. 7, 1979, entitled "Pump Assembly Comprising Gas Spring Means", and co-pending application Ser. No. 073,395, filed Sept. 7, 1979, entitled "Rodless Pump Comprising Reference Pressure Means" with each being assigned to the same assignee as this application.

BACKGROUND OF THE INVENTION

1. Field of the Invention

The present invention relates in general to a rodless pump system for use in an oil well, for example, and in particular to a rodless pump system having a surface unit for applying fluid pressure to a fluid conduit and a subsurface pump responsive to the fluid pressure for lifting fluid from the well into the fluid conduit.

2. Description of the Prior Art

Presently, low pressure, non-flowing oil wells account for over about 90% of the oil wells in the United States. There are various means available for pumping these non-flowing oil wells, the most common of these pump means being the sucker rod type subsurface pump. Other types of pumps include electrical and hydraulic actuated subsurface pumps. A feature which is common to each of these subsurface pumps is that each utilizes a separate energy transmission mechanism other than the production fluid conduit for supplying the actuating energy to the pump, resulting in expensive energy transmission paths, requiring considerable maintenance and cost.

Although sucker rod type pumps are not the most energy efficient, they are probably the most reliable. However, sucker rod failures are still a major problem, as studies have shown that a sucker rod fails an average of once every two years. These failures result in significant repair and maintenance costs.

There have been several attempts to provide a rodless subsurface pump system which does not require an energy transmission mechanism for activating the pump. This type of pump system typically includes a surface unit which is connected to the subsurface pump by a single fluid conduit. The surface unit activates the subsurface pump by applying pressure to the fluid in the conduit to compress a spring means in the pump and displace a slidable piston to draw fluid from the well into a pump chamber. When the surface unit releases the fluid pressure, the spring means of the subsurface pump will displace the piston and lift the fluid in the pump chamber into the fluid conduit. Such systems are disclosed in U.S. Pat. Nos. 2,058,455; 2,123,139; 2,126,880 and 2,508,609.

However, these pressure activated subsurface pump systems have some inherent problems. When fluid pressure is applied to the fluid conduit, the actual energy applied to the system is much greater than the energy supplied to the subsurface pump. Since thousands of feet typically separate the surface unit and the subsurface pump, considerable work is done compressing the fluid in the conduit, ballooning the conduit, and moving fluid to compress the subsurface pump spring. In these systems, typically more energy is consumed in compression and ballooning than is used to energize the subsurface pump. Because fluid pressure is simply relieved typically to atmospheric pressure while taking production, the compression energy is wasted.

SUMMARY OF THE INVENTION

The present invention is related to a pumping apparatus for pumping fluid from a subterranean well through a tubing string. The apparatus defines pump means which are connected to the tubing string and are responsive to the cyclic application of pressure to the fluid in the tubing string for pumping fluid from the well into the tubing string. Means are provided for cyclically applying pressure to the fluid in the tubing string to actuate the pump means and to supply, capture and substantially reuse energy within and through the tubing string. The tubing string releases stored potential energy during the cycles of applied pressure. The means for cyclically applying pressure also includes means for converting a portion of the released potential energy into kinetic energy.

DESCRIPTION OF THE PREFERRED EMBODIMENTS

Figure 1:
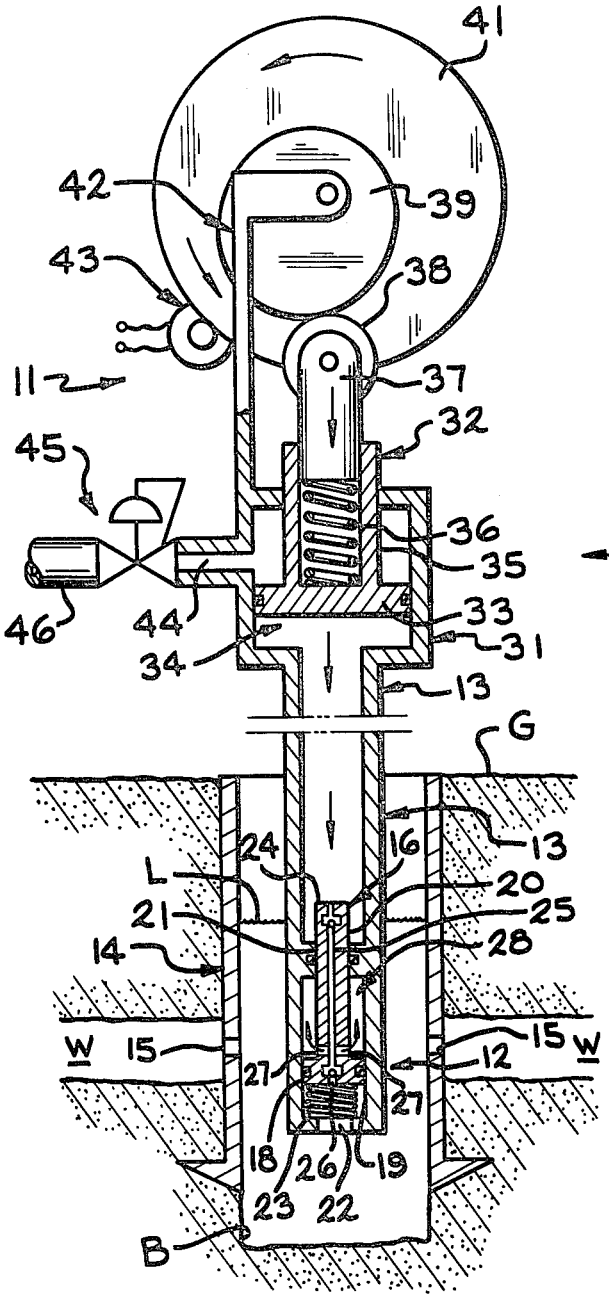
FIG. 1 is a schematic illustration of a rodless pump system incorporating the features of the present invention during the downward movement of the pump elements.
Figure 2:
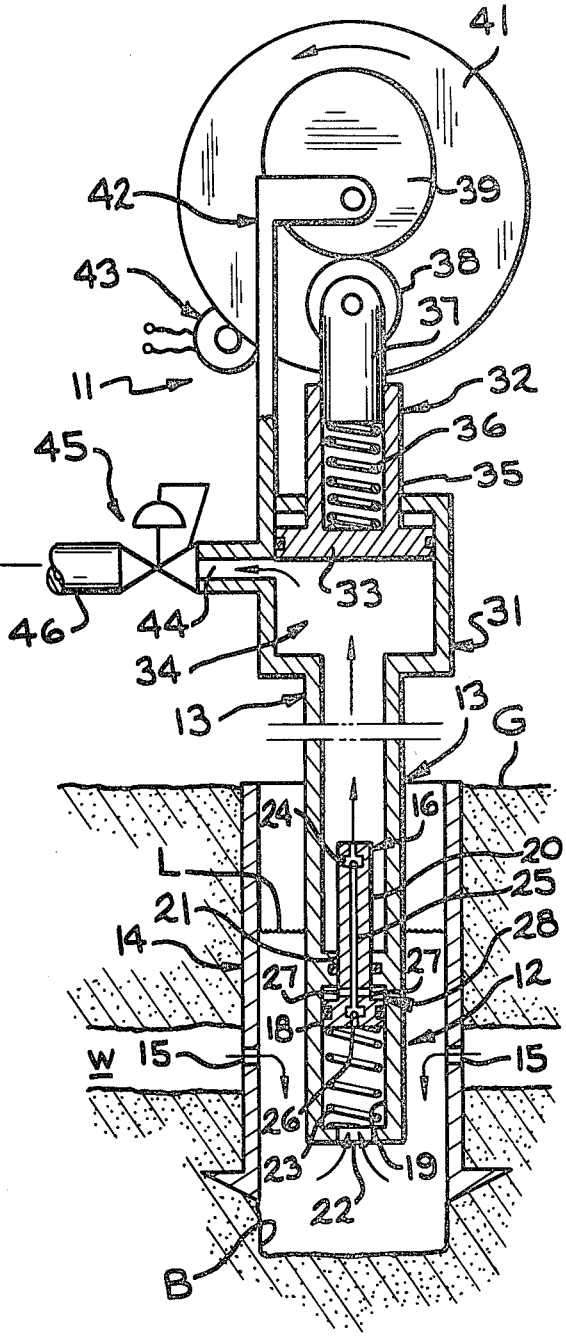
FIG. 2 is a schematic illustration of a rodless pump system, as illustrated in FIG. 1, during the upward movement of the pump elements.

Referring to FIGS. 1 and 2, there is shown in schematic form a rodless pump system incorporating the features of the present invention. The pump system includes a surface unit generally indicated by a reference numeral 11 and a pressure actuated subsurface pump generally indicated by a reference numeral 12. The surface unit 11 and the pressure actuated subsurface pump 12 are in fluid communication with opposite ends of a tubing string 13. The surface unit 11 functions to cyclically apply pressure to fluid in the tubing string 13 to actuate the subsurface pump 12. In addition to actuating the subsurface pump 12, this pressure produces radial expansion, or a "ballooning" effect, on the tubing string, such that potential energy is stored within the tubing string. Additionally, this same pressure causes the fluid within the tubing string to compress, resulting in additional stored potential energy. Energy supplied to the subsurface pump is useful energy and will be consumed in lifting fluid. Tubing "ballooning" energy and fluid compression energy must be supplied to energize the pump, but are substantially recaptured to cyclical reuse.

The surface unit 11 includes means for converting the potential energy stored in the tubing string and within the compressed fluid into an energy form suitable for re-applying fluid pressure to activate the subsurface pump 12 on the next cycle, resulting in a rodless pump system having increased efficiency. As will be discussed, FIGS. 1 and 2 each represents a particular portion of the pumping cycle.

The subsurface pump 12 is connected to the tubing string 13 which extends to the top of the well G of a previously drilled bore hole B. A casing or other conduit 14 is inserted into the bore hole B to prevent the walls of the bore hole B from collapsing. The casing 14 has ports 15 perforated into the side walls thereof to permit fluid to flow from a well production zone W into the casing 14 such that a fluid annulus having a level L surrounds the subsurface pump 12.

The subsurface pump 12 includes a piston assembly 16 having a lower piston head 18 slidably mounted within a piston chamber 19 and a reduced diameter piston rod 20 slidably mounted in an aperture 21 formed in the upper end of the chamber 19. If desired, the outer annular surface of the piston head 18 can be provided with a suitable sealing means for sealingly engaging the side walls of the piston chamber 19. Similarly, the annular surface of the aperture 21 can be provided with a suitable sealing means for sealingly engaging the outer surface of the piston rod 20.

The piston chamber 19 includes an intake port 22 formed in the bottom end thereof for receiving fluid from the fluid annulus in the casing 14. A helical compression spring 23 has an upper end abutting the bottom surface of the piston 18 and a lower end resting on the lower surface of the piston chamber 19. As will be discussed, the spring 23 exerts an upward force on the piston assembly 16 which is utilized to lift fluid into the tubing string 13.

The piston assembly 16 further includes an upper check valve 24 located at the top of the piston rod 20 which provides selective fluid communication between the interior of the tubing string 13 and a fluid passageway 25 centrally located in the piston assembly 16. A lower check valve 26 located in the piston 18 provides selective fluid communication between the portion of the piston chamber 19 below the piston 18 and the fluid passageway 25. A pair of fluid passageways 27 provide a fluid path between the passageway 25 and a pump cavity 28. The pump cavity 28 is the volume defined between the upper portion of the piston chamber 19 and the rod 20 of the piston 18.

The reciprocating motion of the piston assembly 16 causes fluid in the lower portion of the piston chamber 19 to be transported upward into the tubing string 13. On the downstroke of the piston assembly 16, the upper check valve 24 is closed and the lower check valve 26 is opened such that the fluid below the piston 18 flows through the passageways 27 into the pump cavity 28. On the upstroke of the piston assembly 16, the lower check valve 26 is closed and the upper check valve 24 is opened such that the fluid in the pump cavity 28 flows through passageways 27 and up the passageway 25 into the tubing string 13. The operation of the subsurface pump 12 will be discussed in more detail following a description of the surface unit 11.

The surface unit 11 includes a surface pump 31 for cyclically applying pressure to the fluid in the tubing string 13 for activating the subsurface pump 12. The surface pump 31 includes a surface piston assembly 32 having a piston head 33 slidably mounted within a pump chamber 34, and a tubular piston rod 35 slidably extending through an aperture in the top wall of the pump chamber 34. A helical compression spring 36 is located within a cylindrical cavity formed in the piston rod 35. The spring 36 has a lower end which rests on the lower end of the cylindrical cavity and an upper end which exerts an upward force on a cam follower support 37. The support 37 is slidably positioned in the interior of the piston rod 35 and includes means for rotatably mounting a cam follower 38.

The spring 36 is a force limiting spring which permits the system to automatically compensate for displacement changes resulting from variation in fluid compressibility and specific gravity. The fluid received from the well W is not a homogeneous mixture, and typically includes varying mixtures of water, gas and oil, each possibly having a different specific gravity and compressability. These changing mixtures may require different pressures and displacements from the surface piston assembly 32 in order to supply a consistent amount of energy to the subsurface pump 12. The spring 36 provides a means for achieving variable displacement from the surface piston assembly 32 which is large enough for the maximum expected fluid compressibility, while protecting the system from excessive pressures.

A cam 39 and a flywheel 41 are suitably mounted such that they share a common axis of rotation. A support arm 42 includes means for rotatably positioning the cam 39 and the flywheel 41 above the cam follower 38 such that the cam follower 38 engages the cam 39.

The cam 39 permits the displacement of the piston assembly 32 to be controlled as a function of time. The cam 39 can be designed to compensate for changes in flywheel rotation rates or, in a continuous rotation flywheel system, to provide different compression and expansion cycles. Also, in some instances, it may be desirous to provide a dwell at the minimum system pressure to permit production delivery without displacement of the surface piston assembly.

An electric motor 43 is connected to a source of electric power (not shown) and includes drive means which engages the flywheel 41 for resupplying energy to the system. The motor 43 can be either an A.C. or D.C. type which runs continuously or is controlled so that only the required amount of energy is added to the system.

An outlet port 44 is formed in the side wall of the surface pump chamber 34. The location of the port 44 in the chamber 34 is such that fluid can flow from the chamber 34 into the port 44 only when the piston assembly 32 is in the top portion of its stroke and fluid pressure is near the minimum. A back pressure valve 45 is connected between the outlet port 44 and a production line 46. The valve 45 maintains the fluid in the system at a selected minimum pressure. Typically, the minimum pressure is selected to be above the vapor pressure of the fluid in the tubing string 13 to minimize the formation of gas pockets in the fluid. Free gas bubbles within the tubing string 13 can cause significant volume displacement changes and unrecoverable thermodynamic losses. Thus, if the fluid pressure is maintained above the fluid vapor pressure, free gas formation can be avoided.

OPERATION

FIG. 1 illustrates the portion of the pumping cycle wherein pressure is exerted on the fluid in the tubing string 13 to activate the subsurface pump 12. As shown in FIG. 1, the cam 39 is rotated counterclockwise to urge the cam follower 38 and the support 37 downwardly to compress the spring 36. The spring 36 exerts a downward force on the surface piston assembly 32 to downwardly displace the piston assembly 32 and compress the fluid within the surface pump chamber 34 and the tubing string 13.

The pressure fluid in the tubing string 13 produces a resultant downward force on the subsurface piston assembly 16. When the resultant fluid downward force exceeds the upward force exerted by the spring 23, the piston assembly 16 is displaced downwardly. The upper check valve 24 prevents the pressure fluid in the tubing string 13 from entering the passageway 25, while the lower check valve permits fluid below the piston 18 to flow through the passageways 27 into the pump cavity 28.

When the cam 39 has rotated such that the high point of the cam engages the cam follower 38, the surface piston assembly 32 is at its lowermost position and the fluid in the tubing string is at its maximum pressure. The subsurface piston assembly 16 is also at its lowermost position, and the pump cavity 28 is filled with fluid at a maximum volume. At this time, the rotating velocity of the flywheel 41 is at a minimum, while the compression forces of the pressure fluid in the tubing string 13 are at a maximum. The compression forces create a "ballooning" effect of the tubing string 13 representing the potential energy of the tubing string 13, which is at a maximum at this point. Additionally, fluid pressure compresses the fluid within the tubing string, representing the potential energy of fluid compression, which also is at a maximum at this point. Thus, when the high point of the cam 39 engages the cam follower 38, the kinetic energy of the flywheel 41 is at a minimum while the potential energy of the tubing string 13 is at a maximum.

As the cam 39 and the flywheel 41 continue to rotate, the fluid in the tubing string expands and the tubing string contracts. This results in upward force on the surface piston assembly 32 which causes the cam follower 38 to accelerate the cam 39 and the flywheel 41. Hence, the potential energy stored in the tubing string is transformed into kinetic energy stored in the rotating flywheel 41. This kinetic energy can be utilized to pressurize the tubing string on the next pumping cycle.

When the fluid pressure in the tubing string 13 falls below the fluid pressure in the subsurface pump cavity 28, the spring 23 urges the piston assembly 16 upward such that the fluid in the pump cavity 28 flows through passageways 27 and 25 and the check valve 24 into the tubing string 13. The fluid in the casing 14 then is resultantly drawn into the chamber 19 through the intake port 22. When the surface piston assembly is displaced to its uppermost position, as shown in FIG. 2, fluid in the pump chamber 34 flows through the port 44 and the valve 45 into the production line 46. At this time, the tubing string 13 is in a state of minimum potential energy (or minimum cyclic pressure), while the flywheel 41 is in a state of maximum kinetic energy.

As the rotating momentum of the flywheel 41 drives the cam 39, the cam follower 38 and the piston assembly 32 are forced downwardly to begin a new pumping cycle. The rotating speed of the flywheel 41 is reduced as the fluid in the tubing string 13 is compressed. Hence, the kinetic energy of the flywheel is transformed to potential energy in the form of fluid compression and tubing ballooning. When the fluid pressure in the tubing string 13 is sufficient to overcome the upward force of the spring 23, the piston assembly 16 is displaced downwardly, as shown again in FIG. 1, to draw fluid into the pump cavity 28.

It should be noted that it is not necessary for the cam 39 and the flywheel 41 to be continuously rotated. For example, the apparatus would also function if the rotation of the cam 39 and the flywheel 41 was stopped and reversed for each pumping cycle.

The system illustrated in FIGS. 1 and 2 is representative of a mechanical energy conversion system which utilizes a "spring mass" approach. In a "spring mass" system, potential energy in the form of a compressed spring or a pressurized fluid, for example, is converted to kinetic energy in the form of a moving mass such as a swinging pendulum or a rotating flywheel, for example. Mechanical devices such as those mentioned above will be very efficient at converting potential energy to kinetic energy, and back again.

Several changes can be made to the system shown in FIGS. 1 and 2. For example, a gear box can be installed between the cam 39 and the flywheel 41 to minimize flywheel mass. Also, an internal combusion engine or other auxiliary power source can be utilized instead of the electric motor 43. Furthermore, the surface pump 31 can be a gear pump, a variable displacement pump or a screw pump.

Although a mechanical energy conversion system is illustrated in FIGS. 1 and 2, it may be desirous in some instances to utilize an electrical system. In this system, a battery powered D.C. motor could be utilized to drive the surface pump to apply pressure to the tubing string and, subsequently, the tubing pressure could be used to reverse drive the pump and cause the D.C. motor to generate electric current to partially recharge the battery. Thus, the energy returned to the battery would represent conserved energy which could be used for the next pumping cycle.

In summary, the present invention concerns an apparatus for pumping fluid from a well through a string of tubing. The apparatus includes a first pump means or subsurface pump connected to the tubing string and responsive to the cyclic application of pressure to the fluid in the tubing string for pumping fluid from the well into the tubing string. The apparatus also includes a second pump means for cyclically applying the pressure to the fluid in the tubing string to actuate the first pump means. The apparatus also provides means for supplying, capturing and substantially reusing energy associated with fluid compression and tubing "ballooning".

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for pumping fluid from a subterranean well through a tubing string, comprising: pump means connected to the tubing string and responsive to the cyclic application of pressure to the fluid in the tubing string for pumping fluid from the well into the tubing string; and means for cyclically applying pressure to the fluid in the tubing string to actuate said pump means and to supply energy to the tubing string, said means for cylically applying pressure being responsive to the fluid in the tubing string to capture and substantially reuse said energy within and through the tubing string.

2. The apparatus of claim 1 wherein the tubing string releases stored potential energy during the cycles of applied pressure.

3. The apparatus of claim 1 or 2 wherein said means for cyclically applying pressure further includes means for converting a portion of released potential energy into kinetic energy to cyclically apply said pressures to the fluid in the tubing string.

4. The apparatus of claim 1 or 2 wherein the means for cyclically applying pressure includes means for storage of energy for substantial cyclical reuse, said storage means being at least one of potential and kinetic energy.

5. The apparatus according to claim 1 or 2 wherein said pump means includes means responsive to the cyclic application of pressure to the fluid in the tubing string for drawing fluid from the well and for forcing the fluid into the tubing string.

6. The apparatus according to claim 5 wherein said means responsive to the cyclic application of pressure to the fluid includes: a cylinder in communication with the tubing string; a piston slidably movable in said cylinder defining a variable volume pump cavity; and means urging said piston in a first direction, said piston being responsive to the fluid for moving said piston in a second direction in said cylinder to draw fluid from the well into the pump cavity and responsive to said urging means for moving said piston in the first direction in said cylinder to force the fluid from the pump cavity and into the tubing string.

7. The apparatus according to claim 6 wherein said pump means includes a passageway formed therein for fluid communication between the well and the pump cavity and a first check valve means for allowing fluid flow only from the well to the pump cavity.

8. The apparatus according to claim 6 wherein said pump means includes a passageway formed therein for fluid communication between the pump cavity and the tubing string and a second check valve means for allowing fluid flow only from the pump cavity to the tubing string.

9. The apparatus according to claim 4 wherein said means for storage of energy includes kinetic energy storage means.

10. The apparatus according to claim 4 wherein said means for storage of energy includes a rotatably flywheel for storing kinetic energy.

11. The apparatus according to claim 1 wherein said means for cyclically applying pressure includes means for converting a first potential energy into one of kinetic and a second potential energy for storage; and means for cyclically reconverting a portion of one of said kinetic and second potential energy into said first potential energy.

12. The apparatus according to claim 1 wherein said means for cyclically applying pressure includes a cylinder connected to the tubing string and a piston slidably movable in said cylinder, said piston being responsive to one of kinetic and a second potential energy for moving in a first direction to apply the pressure to the fluid in the tubing string and being responsive to a first potential energy for moving in a second direction.

13. The apparatus according to claim 12 wherein the kinetic energy is supplied through a rotatable flywheel and cam, said flywheel storing energy and releasing a portion of said stored energy in cycles through said cam to move said piston in the first direction, said piston operably extending to said cam and said cam being rotatably engageable with said flywheel.

14. The apparatus according to claim 13 wherein the movement of said piston in the second direction drives said flywheel through said cam to convert at least a portion of the first potential energy to energy stored in said flywheel.

15. A rodless pump for pumping fluid from a subterranean well through a string of tubing comprising: a first pump connected to the tubing string and responsive to the cyclic application of pressure to the fluid in the tubing string for drawing fluid from the well and into the tubing string; a second pump responsive to the cyclic application of input energy for cyclically applying pressure to the fluid in the tubing string to actuate said first pump and to store potential energy in the tubing string, the tubing string releasing the stored potential energy during the cycles of applied pressure, said second pump converting a portion of the released potential energy into stored energy for subsequent conversion into input energy; and a source of said cyclic input energy.

16. The pump according to claim 15 wherein said first pump includes a cylinder connected to the tubing string, a piston slidably movable in said cylinder for defining a variable volume pump cavity; and means urging said piston in a first direction, said piston being responsive to the fluid at or above a predetermined pressure for moving in an opposite direction to draw fluid from the well into said pump cavity and being responsive to said means when the fluid is below the predetermined pressure for moving in the opposite direction to convey the fluid from said pump cavity to the tubing string.

17. The pump according to claim 15 wherein said second pump includes a cylinder connected between the tubing string and a discharge tube and a piston slidably movable in said cylinder, said piston being responsive to said input energy for moving in a first direction to apply pressure to the fluid in the tubing string and being responsive to the released potential energy for moving in a second direction.

18. The pump according to claim 17 wherein said source of cyclic input energy includes a rotatable flywheel, a cam and a drive means for rotating said flywheel and cam, said flywheel storing kinetic energy and releasing a portion of the stored kinetic energy in cycles through said cam to move said piston in said first direction, said piston operably extending to said cam and said cam being rotatably engageable with said flywheel.

19. The pump according to claim 18 wherein the movement of said piston in said second direction drives said flywheel through said cam to convert at least a portion of the released potential energy to kinetic energy stored in said flywheel.

20. The pump according to claim 18 wherein said second pump includes a cam follower slidably mounted on said piston and a spring for forcing said cam follower into contact with said cam.

21. A method of pumping a fluid through a conduit comprising the steps of: introducing fluid into the conduit; cyclically applying a primary pressure to the fluid in the conduit to draw fluid from a source into the conduit and sequentially withdraw fluid from the conduit; concurrently causing energy to be stored in the conduit during the application of pressure to the fluid therein; and subsequently converting the potential energy stored in the conduit to a kinetic energy to be thereafter applied to the fluid in the conduit during a subsequent application of the primary pressure thereto.

22. A downhole rodless pump for pumping fluid from a subterranean well through a string of tubing comprising: a first pump connected to the tubing string and responsive to the cyclic application of pressure to the fluid in the tubing string for drawing fluid from the well and into the tubing string; and a second pump responsive to the cyclic application of input energy for cyclically applying pressure to the fluid in the tubing string to actuate said first pump and to store potential energy in the tubing string, the tubing string releasing the stored potential energy between the cycles of applied pressure, said second pump converting at least a portion of the released potential energy into stored energy.

23. The apparatus according to claim 1, 15 or 22 additionally comprising means for removing the pumped fluid from the subterranean well through a transmission conduit when the tubing string is substantially at minimum cyclic pressure.

24. The apparatus according to claim 1, 15 or 22 additionally comprising means for automatic displacement compensation to the pumped fluid from the subterranean well.

25. The apparatus according to claim 1, 15 or 22 additionally comprising means for control of minimum pressure level within the tubing string.

26. The apparatus according to claim 1, 15 or 22 additionally comprising means whereby fluid within the tubing string is displaced variably as a function of time.

27. The apparatus according to claim 1, 15 or 22 wherein the fluid in the tubing string comprises the fluid pumped from the subterranean well.

* * * * *